US006042114A

United States Patent [19]

Phillip

[11] Patent Number: 6,042,114

[45] Date of Patent: Mar. 28, 2000

[54] GAMING MACHINE

[76] Inventor: Wilkinson C. Phillip, 176 Virginia Boulevard, Box 15-A Sutton West, Ontario, Canada, L0E 1R0

[21] Appl. No.: 09/105,442

[22] Filed: Jun. 26, 1998

[51] Int. Cl.[7] ..... A63F 5/02

[52] U.S. Cl. ..... 273/142 R; 273/142 D; 273/142 E

[58] Field of Search ..... 273/142 R, 142 E, 273/142 F, 142 G, 142 H, 142 HA, 142 J, 142 JA, 142 JC

[56] References Cited

U.S. PATENT DOCUMENTS 1,474,488 11/1923 Nelson ..... 273/142 F
1,578,412 3/1926 Ewig ..... 273/142 E
3,853,324 12/1974 Reiner et al. ..... 273/142 F
4,792,137 12/1988 McKechnie ..... 273/138.2
5,553,851 9/1996 Malavazos et al. ..... 273/142 E

*Primary Examiner*—Benjamin H. Layno

[57] ABSTRACT

A gaming apparatus is provided including a rotating wheel assembly having an inner portion with a plurality of sections and an outer portion with a plurality of ball receiving areas. A spinning assembly is rotatably mounted on the rotating wheel assembly for selecting one of the sections of the inner portion of the rotating wheel assembly. Further included is a ball for being randomly deposited in one of the ball receiving areas.

14 Claims, 7 Drawing Sheets

FIG. 11
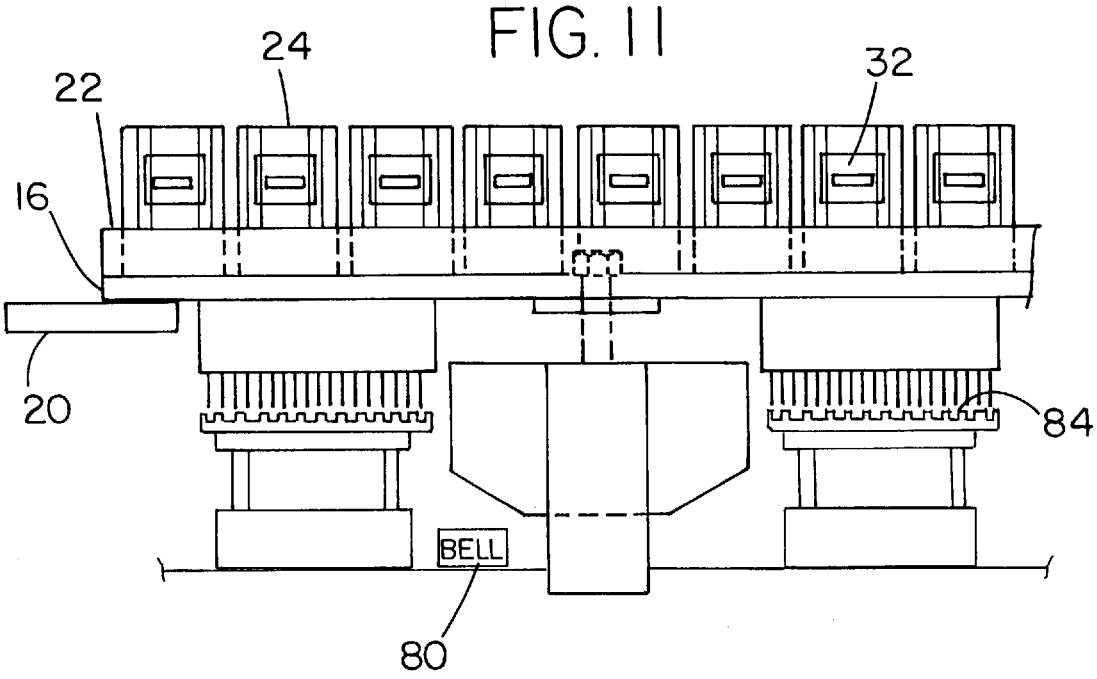
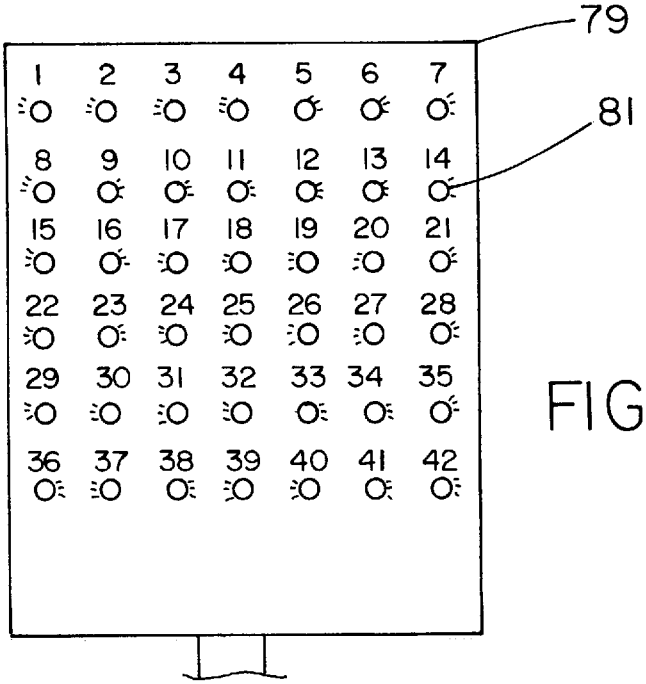
FIG. 12

GAMING MACHINE

BACKGROUND OF THE INVENTION

1. Field of the Invention

The present invention relates to gambling apparatuses and more particularly pertains to a new gaming machine for gambling in various ways on a single apparatus.

2. Description of the Prior Art

The use of gambling apparatuses is known in the prior art. More specifically, gambling apparatuses heretofore devised and utilized are known to consist basically of familiar, expected and obvious structural configurations, notwithstanding the myriad of designs encompassed by the crowded prior art which have been developed for the fulfillment of countless objectives and requirements.

Known prior art gambling apparatuses include U.S. Pat. No. 4,492,378; U.S. Pat. No. 3,633,915; U.S. Pat. No. 4,346,900; U.S. Pat. No. Des. 204,609; U.S. Pat. No. Des. 345,585; and U.S. Pat. No. 1,670,692.

In these respects, the gaming machine according to the present invention substantially departs from the conventional concepts and designs of the prior art, and in so doing provides an apparatus primarily developed for the purpose of gambling in various ways on a single apparatus.

SUMMARY OF THE INVENTION

In view of the foregoing disadvantages inherent in the known types of gambling apparatuses now present in the prior art, the present invention provides a new gaming machine construction wherein the same can be utilized for gambling in various ways on a single apparatus.

The general purpose of the present invention, which will be described subsequently in greater detail, is to provide a new gaming machine apparatus and method which has many of the advantages of the gambling apparatuses mentioned heretofore and many novel features that result in a new gaming machine which is not anticipated, rendered obvious, suggested, or even implied by any of the prior art gambling apparatuses, either alone or in any combination thereof.

To attain this, the present invention generally comprises a wheel assembly supported by a table. A large disk is rotatably mounted on the table. The large disk has situated thereon a plurality of pie-shaped sections each with an outer peripheral section having a unique number situated therein. Mounted on the periphery of the large disk is a plurality of handles each extending radially therefrom. In use, the handles are adapted for manually rotating the wheel assembly. The large disk of the wheel assembly further includes a transparent peripheral lip. Such lip is integrally coupled to the periphery of the large disk of the wheel assembly and extends upwardly therefrom. A plurality of cylinders are provided each with an open end and a closed bottom end mounted on the large disk. Each cylinder is positioned in one of a plurality of inner peripheral sections associated with one of the outer peripheral sections. It should be noted that each cylinder includes a pivoting floor and a pair of semicircular cut outs formed in an upper edge thereof. Further, to remove a ball from within each cylinder, a sliding door is mounted on an outboard side thereof. Fixedly mounted on the large disk is a small disk which is situated in concentric relationship with the large disk. The small disk has an upper surface with a plurality of inboard pie-shaped sections each having a unique color. Associated therewith is a plurality of outboard pie-shaped sections. Each outboard pie-shaped section is equipped with a width less than that of the inboard pie-shaped sections and a unique number situated therein. It should be noted that each of the inboard and outboard sections has at least a pair of upwardly extending pins mounted between adjacent sections. A further component of the wheel assembly is a spinning assembly including a post having a bottom end rotatably mounted to the small disk. An upper end of the post is equipped with a plurality of radially extending arms residing in a single horizontal plane and terminating in a weighted ball. The post further includes a resilient pointer extending radially therefrom adjacent to the bottom end thereof. The pointer and spinning assembly are adapted for being rotated with respect to the small disk, thereby pointing to one of the pie-shaped sections. A ball drop assembly includes a stanchion mounted adjacent the table. An overhang arm is mounted to a top end of the stanchion and situated over the wheel assembly. A plurality of downwardly extending members are coupled to the overhang arm. Mounted to bottom ends of the downwardly extending members is a transparent annular container which is spacedly situated above the cylinders of the wheel assembly. The annular container includes an upper hole formed in a top face thereof and a lower hole formed in a bottom face thereof. A wall is mounted within the annular container adjacent to the lower hole. The ball drop assembly further includes a transparent stand having a launching conduit mounted thereon with a hole formed in a top face thereof. For launching a ball that is dropped within the hole, a spring loaded plunger is positioned within the launching conduit. A vertically oriented drop chute is connected between the launch conduit and the upper hole of the annular container. The drop chute serves for guiding a launched ball into the annular container, out the lower hole and into one of the cylinders of the wheel assembly. Also included is a batting mechanism with a stand having an arm rotatably mounted to a top end thereof. Such rotating coupling is effected at a central extent of the arm. Further, the batting mechanism is positioned such that an inboard end strikes one of the balls upon an outboard end of the batting mechanism being struck. Finally, a game board is provided having a top face with a circular configuration. The top face of the game board has a plurality of pie-shaped sections each corresponding to one of the pie-shaped sections of the small disk or one of the numbers of the large disk.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new gaming machine apparatus and method which has many of the advantages of the gambling apparatuses mentioned heretofore and many novel features that result in a new gaming machine which is not anticipated, rendered obvious, suggested, or even implied by any of the prior art gambling apparatuses, either alone or in any combination thereof.

It is another object of the present invention to provide a new gaming machine which may be easily and efficiently manufactured and marketed.

It is a further object of the present invention to provide a new gaming machine which is of a durable and reliable construction.

An even further object of the present invention is to provide a new gaming machine which is susceptible of a low cost of manufacture with regard to both materials and labor, and which accordingly is then susceptible of low prices of sale to the consuming public, thereby making such gaming machine economically available to the buying public.

Still yet another object of the present invention is to provide a new gaming machine which provides in the apparatuses and methods of the prior art some of the advantages thereof, while simultaneously overcoming some of the disadvantages normally associated therewith.

Still another object of the present invention is to provide a new gaming machine for gambling in various ways on a single apparatus.

Even still another object of the present invention is to provide a new gaming machine that includes a rotating wheel assembly having an inner portion with a plurality of sections and an outer portion with a plurality of ball receiving areas. A spinning assembly is rotatably mounted on the rotating wheel assembly for selecting one of the sections of the inner portion of the rotating wheel assembly. Further included is a ball for being randomly deposited in one of the ball receiving areas.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 11 is a side view of the wheel assembly and associated brush contacts of the present invention.

FIG. 12 is a front view of the light panel of the present invention.

DESCRIPTION OF THE PREFERRED EMBODIMENT

Figure 1:
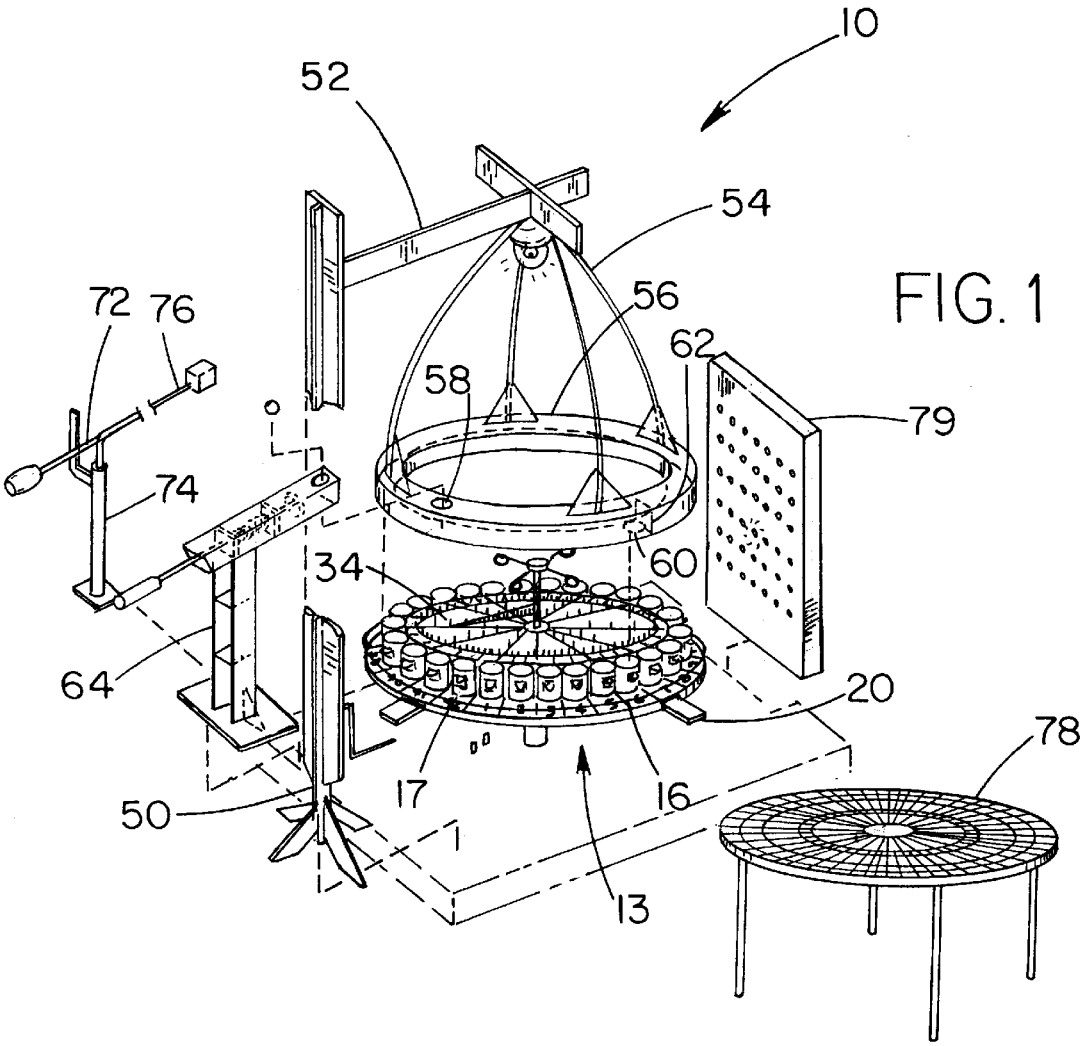
FIG. 1 is an exploded perspective view of a new gaming machine according to the present invention.
Figure 2:
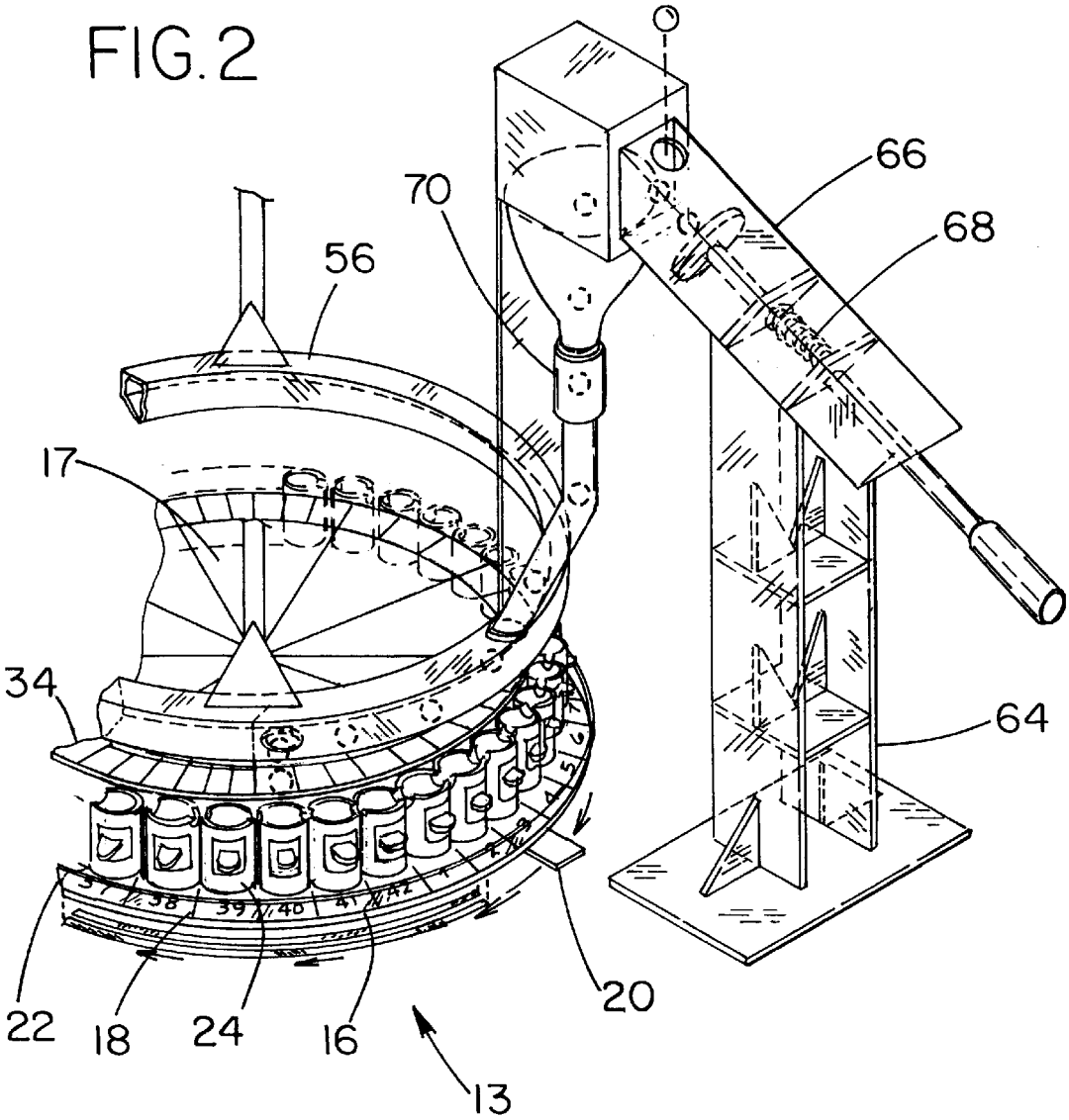
FIG. 2 is a perspective view of the wheel and ball drop assemblies of the present invention.
Figure 3:
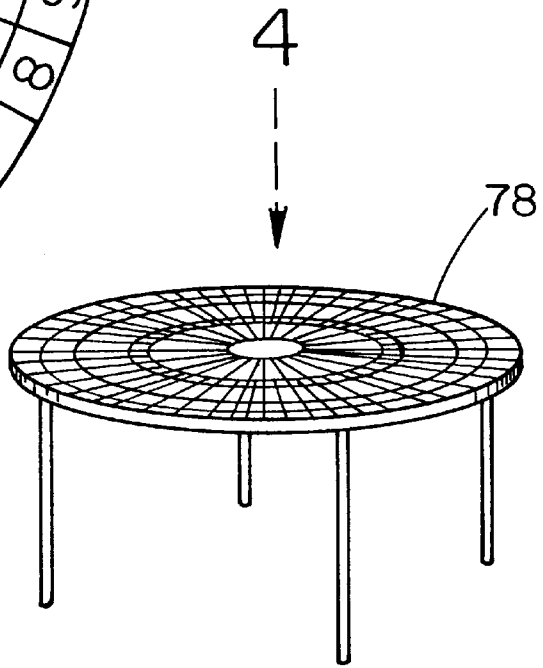
FIG. 3 is a perspective view of the game board of the present invention.
Figure 4:
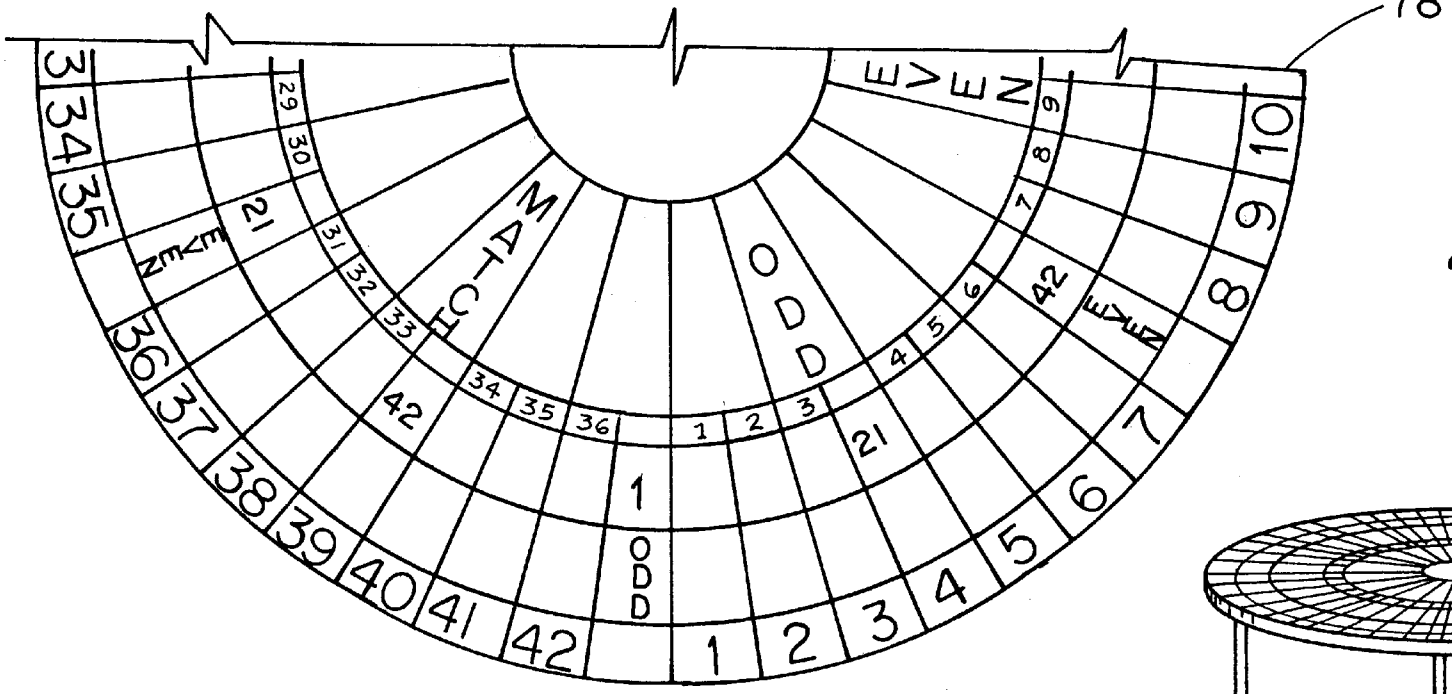
FIG. 4 is a top view of the game board of the present invention.
Figure 5:
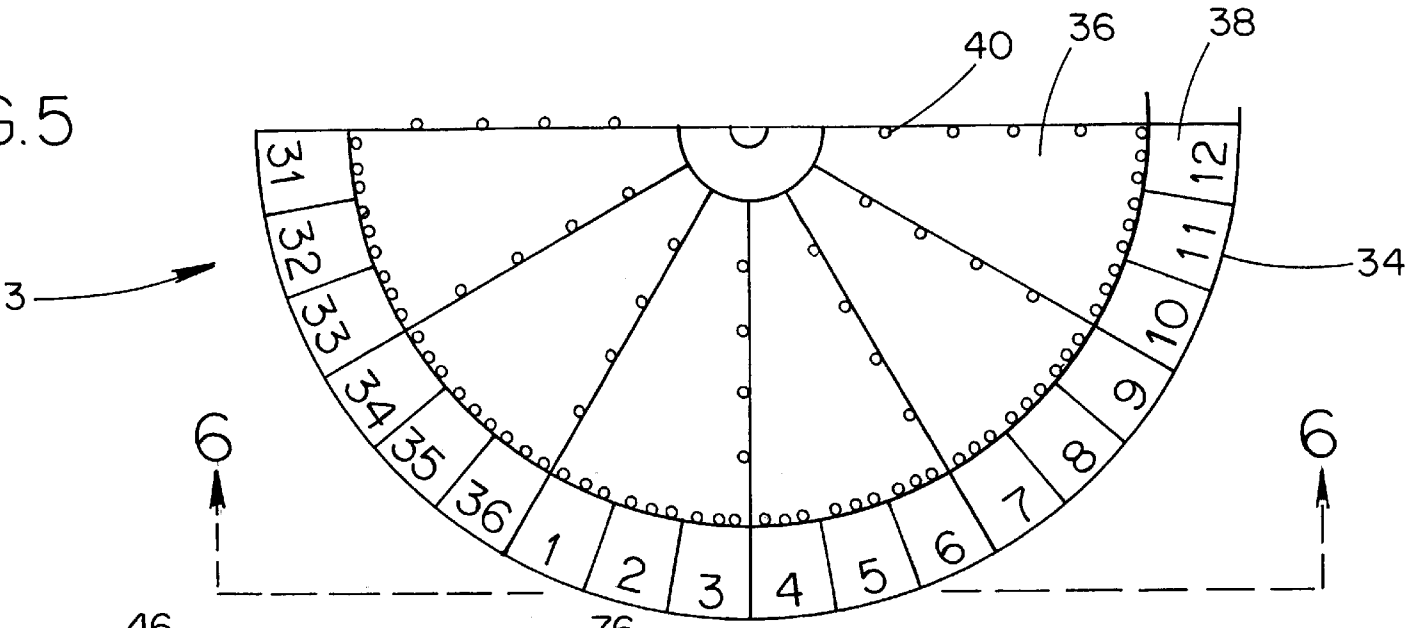
FIG. 5 is a top view of the wheel assembly of the present invention.
Figure 6:
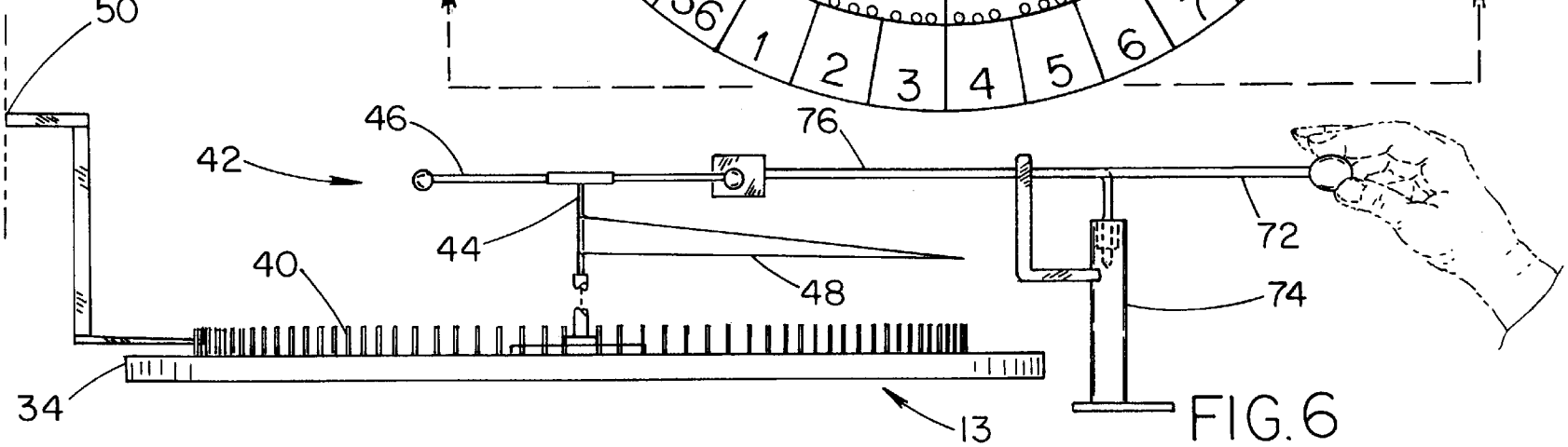
FIG. 6 is a side view of the small disk of the wheel assembly and batting mechanism of the present invention.
Figure 8:
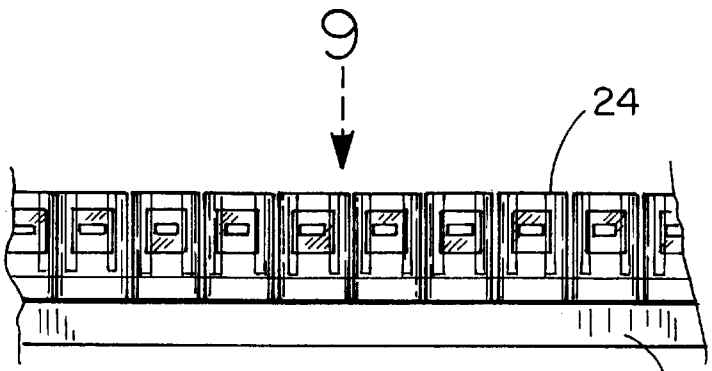
FIG. 8 is a side view of the cylinders of the large disk of the wheel assembly.
Figure 10A:
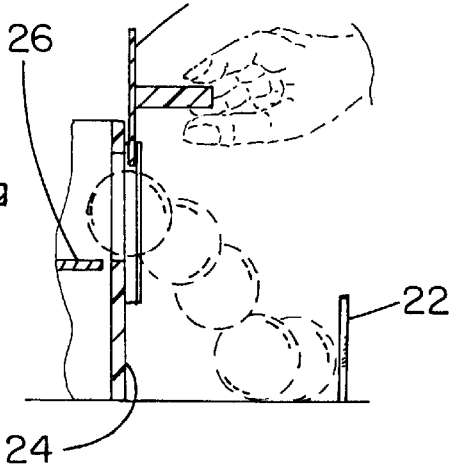
FIG. 10A is a side view of one of the cylinders of the wheel assembly in use.
Figure 10:
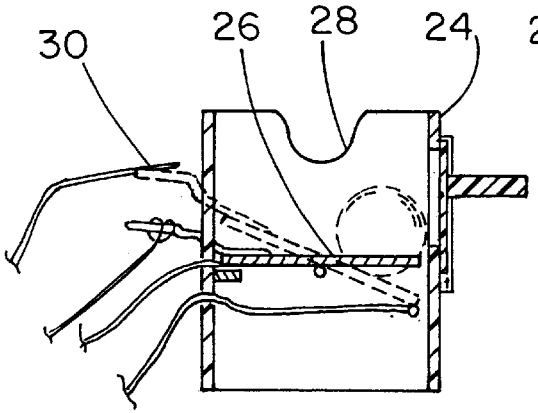
FIG. 10 is a side cross-sectional view of the cylinders of the wheel assembly.
Figure 7:
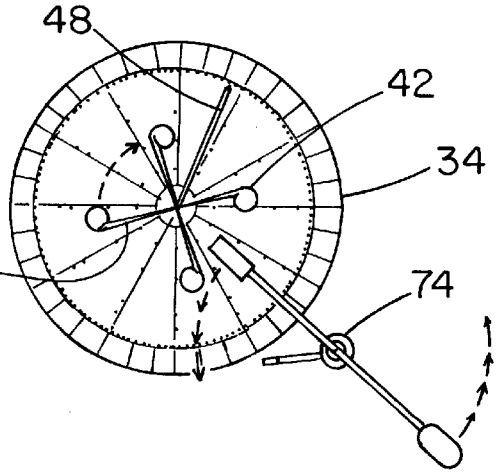
FIG. 7 is a top view of the small disk of the wheel assembly and batting mechanism of the present invention.
Figure 9:
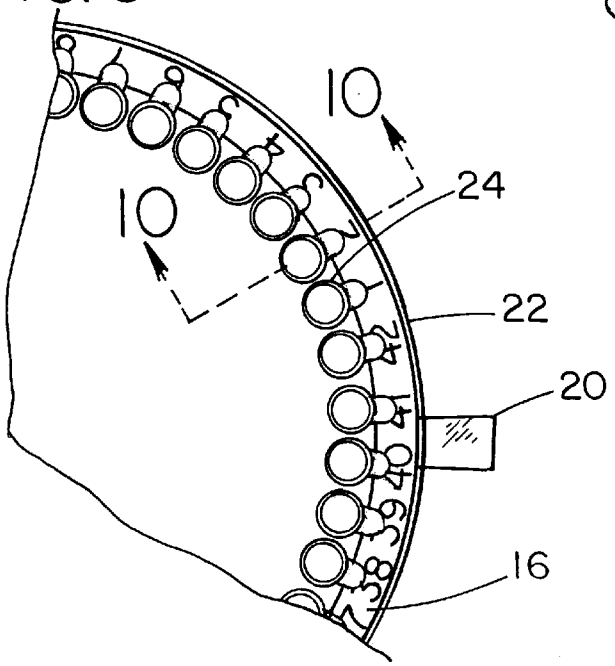
FIG. 9 is a top view of the cylinders and large disk of the wheel assembly of the present invention.
Figure 13:
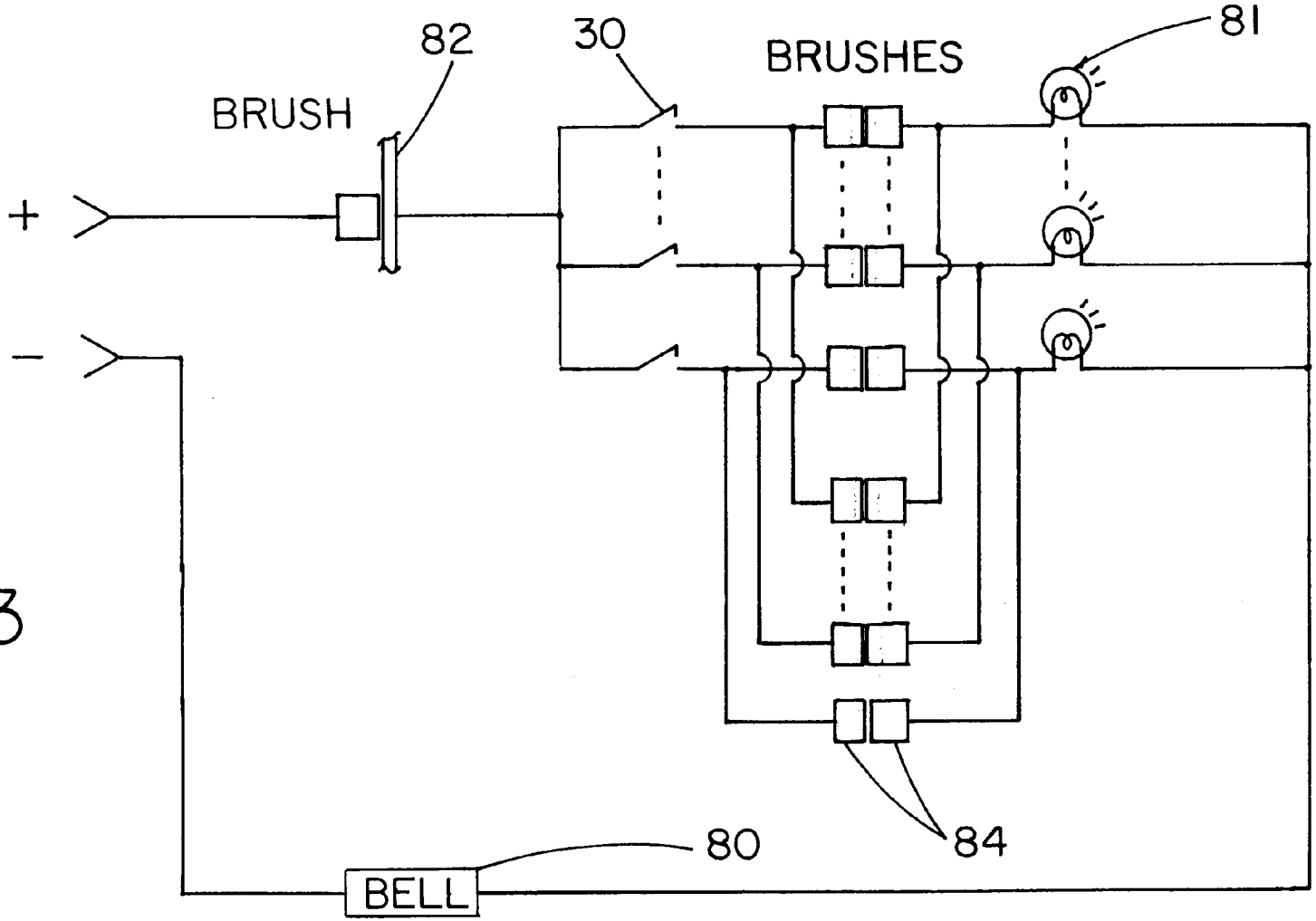
FIG. 13 is a schematic diagram of the present invention.

With reference now to the drawings, and in particular to FIGS. 1 through 13 thereof, a new gaming machine embodying the principles and concepts of the present invention and generally designated by the reference numeral 10 will be described.

The present invention, designated as numeral 10, includes a wheel assembly 13 supported by a table. A large disk 16 is rotatably mounted on the table. The large disk has situated thereon a plurality of pie-shaped sections 17 each with an outer peripheral section 18 having a unique number situated therein. Mounted on the periphery of the large disk is a plurality of handles 20 each extending radially therefrom. In use, the handles are adapted for manually rotating the wheel assembly.

The large disk of the wheel assembly further includes a transparent peripheral lip 22. Such lip is integrally coupled to the periphery of the large disk of the wheel assembly and extends upwardly therefrom. A plurality of cylinders 24 are provided each with an open end and a closed bottom end mounted on the large disk. Each cylinder is positioned in one of a plurality of inner peripheral sections each associated with one of the outer peripheral sections. It should be noted that each cylinder includes a pivoting floor 26 and a pair of semicircular cut outs 28 formed in an upper edge thereof. For reasons that will become apparent, a switch 30 is mounted on the floor of each cylinder for actuating upon the insertion of a ball therein. Further, to remove a ball from within each cylinder, a sliding door 32 is mounted on an outboard side thereof. It should be noted that when removed from one of the cylinders, the ball is prevented by the peripheral lip from falling from the wheel assembly.

Fixedly mounted on the large disk is a small disk 34 which is situated in concentric relationship with the large disk. The small disk has an upper surface with a plurality of inboard pie-shaped sections 36 each having a unique color. Associated therewith is a plurality of outboard pie-shaped sections 38. Each outboard pie-shaped section is equipped with a width less than that of the inboard pie-shaped sections and a unique number situated therein. It should be noted that each of the inboard and outboard sections has at least a pair of upwardly extending pins 40 mounted between the adjacent sections.

A further component of the wheel assembly is a spinning assembly 42 including a post 44 having a bottom end rotatably mounted to the small disk. An upper end of the post is equipped with a plurality of radially extending arms 46 residing in a single horizontal plane and terminating in a weighted ball. The post further includes a resilient pointer 48 extending radially therefrom adjacent to the bottom end thereof. The pointer and spinning assembly are adapted for being rotated with respect to the small disk, thereby pointing to one of the pie-shaped sections.

A ball drop assembly includes a stanchion 50 mounted adjacent the table. An overhang arm 52 is mounted to a top end of the stanchion and situated over the wheel assembly. A plurality of downwardly extending members 54 are coupled to the overhang arm. Mounted to bottom ends of the downwardly extending members is a transparent annular container 56 which is spacedly situated above the cylinders of the wheel assembly. The annular container includes an upper hole 58 formed in a top face thereof and a lower hole 60 formed in a bottom face thereof. A wall 62 is mounted within the annular container adjacent to the lower hole. It should be noted that a lower surface of the annular container is angled to urge the ball through the lower hole.

The ball drop assembly further includes a transparent stand 64 having a launching conduit 66 mounted thereon with a hole formed in a top face thereof. For launching a ball that is dropped within the hole, a spring loaded plunger 68 is positioned within the launching conduit. A vertically oriented drop chute 70 is connected between the launch conduit and the upper hole of the annular container. The drop chute serves for guiding a launched ball into the annular container, out the lower hole and into one of the cylinders of the wheel assembly.

Also included is a batting mechanism 72 with a stand 74 having an arm 76 rotatably mounted to a top end thereof. Such rotatable coupling is effected at a central extent of the arm. Further, the batting mechanism is positioned such that an inboard end strikes one of the balls upon an outboard end of the batting mechanism being struck.

A game board 78 is provided having a top face with a circular configuration. The top face of the game board has a plurality of pie-shaped sections each corresponding to one of the pie-shaped sections of the small disk. Further, the top face of the game board is equipped with numbers corresponding to those of the large disk. Gaming chips are preferably included for marking sections of the game board which are to be betted.

In use, one of three games may be played with the foregoing components. First, the spinning assembly may be rotated with respect to the wheel assembly by way of the batting mechanism. The first two games entail betting with the game board on either the inner or outer pie-shaped sections of the small disk, respectively. In the third game, the handles are used to rotate the wheel assembly after which the ball drop assembly is employed to drop the ball into one of the cylinders. To further indicate into which cylinder the ball has dropped, it is preferred that the switches be connected to a panel 79 having a matrix of lights 81 mounted thereon. Note FIG. 12. Each of such lights corresponds with one of cylinders. A buzzer 80 also activates upon the ball entering any one of the cylinders.

To accomplish this, the wheel assembly includes a first annular brush contact 82 for connecting with a first terminal of a power supply. Such brush contact is in turn connected to the switches of each of the cylinders which are connected to a plurality of annular brush contacts 84 positioned on a bottom of the wheel assembly. Note FIG. 11. These annular brush contacts are connected to the matrix of lights of the panel and the bell for affording the function set forth hereinabove. See FIG. 13.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A gaming apparatus comprising, in combination:

a table;

a wheel assembly including:

a large disk rotatably mounted on the table with a plurality of pie-shaped sections situated thereon each with an outer peripheral section having a unique number situated therein, a plurality of handles each mounted to the periphery of the large disk and extending radially therefrom for manually rotating the wheel assembly, a transparent peripheral lip integrally coupled to the periphery of the large disk of the wheel assembly and extending upwardly therefrom, a plurality of cylinders each with an open end and mounted on the large disk in one of a plurality of inner peripheral sections associated with one of the outer peripheral sections, each cylinder including a pivoting floor, a pair of semicircular cut outs formed in an upper edge of the cylinder, a switch mounted on the floor for actuating upon the insertion of a ball therein, and a sliding door mounted on an outboard side thereof for removing a ball within the cylinder, a small disk fixedly mounted on the large disk in concentric relationship therewith, the small disk having an upper surface with a plurality of inboard pie-shaped sections positioned thereon each of which has a unique color and a plurality of outboard pie-shaped sections positioned thereon each of which has a width less than that of the inboard pie-shaped sections and further has a unique number situated therein, wherein each of the inboard and outboard sections has at least a pair of upwardly extending pins mounted between adjacent sections, and a spinning assembly including a post having a bottom end rotatably mounted to the small disk and an upper end with a plurality of radially extending arms residing in a single horizontal plane and terminating in a weighted ball, the post further including a resilient pointer extending radially therefrom adjacent to the bottom end thereof for being rotated with respect to the small disk, thereby pointing to one of the pie-shaped sections;

a ball drop assembly including a stanchion mounted adjacent the table, an overhang arm mounted to a top end of the stanchion and situated over the wheel assembly, a plurality of downwardly extending members coupled to the overhang arm, and a transparent annular container mounted to bottom ends of the downwardly extending members, the annular container being spacedly situated above the cylinders of the wheel assembly, the annular container including an upper hole formed in a top face thereof and a lower hole formed in a bottom face thereof with a wall mounted within the annular container adjacent to the lower hole, the drop assembly further including a transparent stand, a launching conduit with a hole formed in a top face thereof and a spring loaded plunger for launching a ball dropped within the hole, and a vertically oriented drop chute connected between the launch conduit and the upper hole of the annular container for guiding a launched ball into the annular container, out the lower hole and into one of the cylinders of the wheel assembly;

a batting mechanism includes a stand having an arm rotatably mounted to a top end of the stand at a central extent thereof, wherein the batting mechanism is positioned such that an inboard end strikes one of the balls upon an outboard end of the batting mechanism being struck; and a game board having a top face with a circular configuration, the top face having a plurality of pie-shaped sections each corresponding to one of the pie-shaped sections of the small disk or one of the numbers of the large disk.

2. A gaming apparatus comprising:

a rotating wheel assembly including an inner portion with a plurality of sections and an outer portion with a plurality of ball receiving areas;

a spinning assembly rotatably mounted on the rotating wheel assembly for selecting one of the sections of the inner portion of the rotating wheel assembly;

a ball for being randomly deposited in one of the ball receiving areas; and a plurality of cylinders each with an open end and mounted on the wheel assembly in one of the plurality of sections of the inner portion associated with one of the plurality of sections of the outer portion, each cylinder including a pivoting floor, and at least one cut out formed in an upper edge of the cylinder.

3. A gaming apparatus as set forth in claim 2 and further including a game surface having a plurality of sections each corresponding to one of the sections of the inner portion or one of the ball receiving areas of the outer portion.

4. A gaming apparatus as set forth in claim 2 and further including a matrix of lights each of which corresponds with one of the ball receiving areas and is adapted to illuminate upon the placement of a ball therein.

5. A gaming apparatus as set forth in claim 2 and further including a ball drop assembly for inserting the ball within one of the ball receiving areas.

6. A gaming apparatus as set forth in claim 5 wherein the ball drop assembly includes a spring biased plunger.

7. A gaming apparatus as set forth in claim 2 wherein the spinning assembly includes at least a pair of radially extending arms for being struck to impart rotational motion on the rotating wheel assembly, and a post having a bottom end rotatably mounted to the wheel assembly and an upper end mounted to the radially extending arms, the post further including a resilient pointer extending radially therefrom adjacent to the bottom end thereof for being rotated with respect to the wheel assembly to point to one of the sections of the inner portion.

8. A gaming apparatus as set forth in claim 2 additionally comprising a plurality of handles each mounted to the periphery of the wheel assembly and extending radially therefrom for manually rotating the wheel assembly.

9. A gaming apparatus as set forth in claim 2 additionally comprising a transparent peripheral lip integrally coupled to the periphery of the wheel assembly and extending upwardly therefrom.

10. A gaming apparatus as set forth in claim 2 additionally comprising a switch mounted on the floor for actuating upon the insertion of a ball therein, and a sliding door mounted on an outboard side thereof for removing a ball from the cylinder.

11. A gaming apparatus as set forth in claim 2 wherein the rotating wheel assembly comprises a large disk with a plurality of pie-shaped sections situated thereon each with an outer peripheral section having a unique number situated therein, and a small disk fixedly mounted on the large disk in concentric relationship therewith, the small disk having an upper surface with a plurality of inboard pie-shaped sections positioned thereon each of which has a unique color and a plurality of outboard pie-shaped sections positioned thereon each of which has a width less than that of the inboard pie-shaped sections and further has a unique number situated therein, wherein each of the inboard and outboard sections has at least a pair of upwardly extending pins mounted between adjacent sections.

12. A gaming apparatus as set forth in claim 2 additionally comprising a ball drop assembly including a stanchion mounted adjacent the rotating wheel assembly, an overhang arm mounted to a top end of the stanchion and situated over the wheel assembly, a plurality of downwardly extending members coupled to the overhang arm.

13. A gaming apparatus as set forth in claim 12 additionally comprising a container mounted to bottom ends of the downwardly extending members, the container being spacedly situated above the wheel assembly, the container including an upper hole formed in a top face thereof and a lower hole formed in a bottom face thereof with a wall mounted in the container adjacent to the lower hole, the drop assembly further including a stand, a launching conduit with a hole formed in a top face thereof and a spring loaded plunger for launching a ball dropped in the hole, and a vertically oriented drop chute connected between the launch conduit and the upper hole of the container for guiding a launched ball into the container, out the lower hole and onto the wheel assembly.

14. A gaming apparatus as set forth in claim 2 additionally comprising a batting mechanism includes a stand having an arm rotatably mounted to a top end of the stand at a central extent thereof, wherein the batting mechanism is positioned such that an inboard end strikes one of the balls upon an outboard end of the batting mechanism being struck.

* * * * *